US007357013B2

(12) United States Patent
Fröhlich

(10) Patent No.: US 7,357,013 B2
(45) Date of Patent: Apr. 15, 2008

(54) MARKING DEVICE FOR ENCODING METALLIC WORKPIECES WITH TWO-DIMENSIONAL MATRIX CODES

(75) Inventor: Konrad Fröhlich, Stuttgart (DE)

(73) Assignee: Borries Markier-Systeme GmbH (DE)

( * ) Notice: Subject to any disclaimer, the term of this patent is extended or adjusted under 35 U.S.C. 154(b) by 481 days.

(21) Appl. No.: 10/537,995

(22) PCT Filed: Nov. 6, 2003

(86) PCT No.: PCT/EP03/12409

§ 371 (c)(1),
(2), (4) Date: Jun. 9, 2005

(87) PCT Pub. No.: WO2004/052660

PCT Pub. Date: Jun. 24, 2004

(65) Prior Publication Data

US 2006/0075800 A1 Apr. 13, 2006

(30) Foreign Application Priority Data

Dec. 10, 2002 (DE) ..... 102 57 532

(51) Int. Cl.
*B21C 51/00* (2006.01)
*B44B 5/00* (2006.01)

(52) U.S. Cl. ..... 72/430; 72/443; 72/17.2; 72/20.1; 400/127; 400/130; 400/124.01; 400/124.04; 400/124.05

(58) Field of Classification Search ..... 72/430, 72/19.8, 20.2, 21.4, 438, 443, 483; 400/124.01, 400/124.04, 124.05, 127, 130; 101/3.1
See application file for complete search history.

(56) References Cited

U.S. PATENT DOCUMENTS

| | | | | |
|---|---|---|---|---|
| 5,015,106 | A | 5/1991 | Robertson et al. | |
| 5,316,397 | A * | 5/1994 | Robertson et al. | 400/124.04 |
| 5,368,400 | A * | 11/1994 | Cyphert et al. | 400/124.01 |
| 5,785,436 | A * | 7/1998 | Harrison et al. | 400/124.01 |
| 6,824,337 | B2 * | 11/2004 | Pentz et al. | 409/132 |
| 6,835,011 | B2 * | 12/2004 | Hirano | 400/124.01 |

FOREIGN PATENT DOCUMENTS

| | | |
|---|---|---|
| CH | 172143 | 9/1934 |
| EP | 0495331 | 7/1992 |

* cited by examiner

*Primary Examiner*—Dmitry Suhol
(74) *Attorney, Agent, or Firm*—Bacon & Thomas, PLLC

(57) ABSTRACT

A marking device for encoding metallic workpieces with two-dimensional matrix codes includes a striking tool for forming the code recesses, driven by an electromagnetic device. The driving movement is performed against the force of a return device. A positioning device displaceable on two axes (x, y) of a plane perpendicular to the striking direction (z) is used for positioning the striking tool in the desired code positions. An electronic control device for controlling movement of the striking tool includes means for presetting a higher current for the electromagnet device during a first acceleration phase of the striking tool and a lower current during a subsequent moving phase until the workpiece is impinged. In this manner, the precision of the code recesses in the workpiece can be exactly set or maintained, so that readability of the coding is substantially improved.

15 Claims, 2 Drawing Sheets

MARKING DEVICE FOR ENCODING METALLIC WORKPIECES WITH TWO-DIMENSIONAL MATRIX CODES

CROSS-REFERENCE TO RELATED APPLICATIONS

This application is a National Phase Application (35 USC 371) of PCT/EP2003/012409 and claims priority of German Application No. 102 57 532.0 filed Dec. 10, 2002.

BACKGROUND OF THE INVENTION

1. Field of the Invention

The invention relates to a marking device for encoding metallic workpieces with two-dimensional matrix codes in which the information is present in the form of recessed embossed dots in a square or rectangular arrangement. The presence or lack of these embossed dots at the respective grid points represents the binary encoded information.

2. The Prior Art

To read back the information without error, the precision in placing the embossed dots is of high importance. The precise shape, size and depth of the dots are critical quality features. This is directly connected to the type of reading technology for such embossed or punched encodings, respectively, by means of CCD cameras. Illumination from the top or the side must create a contrast between light and dark from the respective recess by means of corresponding reflections, which is much more difficult than with printed black and white surfaces located on one level, for which the code was originally developed. A deviating shape or size of the individual recesses can easily cause (or undesirably not cause) a reflection which can lead to an undesired distortion of information. In the aerospace industry, requirements are even stricter for critical components under high load; these requirements aim at avoiding the reduction of mechanical stability due to the "notch effect".

In order to achieve the required precision, the striking tool, normally embodied as a hard metal needle, must strike the metallic workpiece, on the one hand, very rapidly, but on the other hand, with precisely defined and reproducible energy. Many conditions must be taken into account as counteracting the desired precision. In case of an electric drive, for instance, the temperature of the copper coil of the electromagnet can increase during operation, reducing current flow and thus the power consumption of the electromagnet. During longer standstill periods of the marking device, the striking tool which is formed as a magnet keeper, or connected to or operatively connected with a magnet keeper, sticks so that the impact energy at the first dot is reduced. In principle, a striking movement which is too slow causes an oval distortion of the recess when the impact unit moves on during encoding. On the other hand, an impact speed which is too fast leads to a great variation in impact depth, since even minimum differences, e.g. due to overlaid mechanical oscillations in the striking mechanism, lead to slightly different energy outputs of the impact system during the formation of the recess. Furthermore, the material properties of the workpiece also influence the formation of the recess. Finally, mechanical tolerances also lead to errors, if they cause the movement of the magnet keeper to exceed the magnetically substantially linear range.

In known arrangements, the current is only intended to be switched on and off for the electromagnet. Clamping diodes or other overvoltage protection equipment are used for protection against overvoltage, when the electromagnet is switched off, as an inductive load. Bias resistors before the electromagnet for inducing a faster rise or drop of current in the magnet coil by increasing the time constant are also known. In these simple systems, in addition to one-time dimensioning, only the time of disconnecting can be varied after the current is switched on, whereas the entire time course of the working movement results exclusively from dimensioning and the prevailing boundary conditions. With such systems, the required precision cannot be attained.

In controlling solenoid valves, on the one hand, it is well-known to switch back to a lower holding current after the high turn-on current, which is first required for a fast movement. This switchover, however, does not take place until after switching of the valve, i.e. after the movement of the valve member, and is intended first to save energy and secondly to reduce heating of the solenoid valve.

SUMMARY OF THE INVENTION

The invention has as an object the improving of the movement of a striking tool driven by an electromagnet arrangement such that markings in the form of recesses can be formed with substantially higher precision.

Accordingly, the present invention provides a marking device for encoding a metallic workpiece with a two-dimensional matrix code which includes a striking tool; an electromagnetic device for driving the striking tool, with a working movement, to form the two-dimensional matrix code, as plural indentations, in the metallic workpiece; a return device for generating a force in opposition to the working movement; and a positioning device, displaceable in two dimensions within a plane perpendicular to the direction of the working movement, for positioning the striking tool in a desired encoding position. The marking device of the present invention further includes an electronic control unit for controlling the working movement of the striking tool, said electronic control unit setting a first current $I_1$ for the electromagnetic device during a first, acceleration phase of the working movement and setting a second current $I_2$, lower than the first current, during a second, moving phase of the working movement, the second, moving phase extending from the first, acceleration phase until impingement of the striking tool on the metallic workpiece.

Advantageously, according to the invention, the current flow through the electromagnet can be set differently for the acceleration phase and the subsequent moving phase of the striking tool. On the one hand, this results in a fast acceleration, with the striking tool being moved against the workpiece in a defined manner after switchover to the lower current. This results in high regularity and reproducibility of the recess formed. Due to the substantially uniform movement because of the fact that the current is lower during the moving phase, a larger tolerance for the marking device's distance to the workpiece is permissible. With the known devices, a distance which becomes larger causes a deeper recess due to the longer acceleration phase. Also, because the current is lower during the moving phase, an uncontrollable, merely ballistic phase of "free flight" of the striking tool until it impinges on the workpiece surface is avoided, which would otherwise occur if the current were switched off before the tool impinges the workpiece; which, in turn, would be associated with larger tolerances of the markings.

In a simple embodiment, current switchover from the higher to the lower value in one or more steps, or continuously, takes place by means of a time control. Alternatively, this switchover can also take place in dependence on the position, with a position measuring device for controlling switchover being provided in at least one preset position. In the simplest case, this position measuring device can be a simple position sensor in a specific position or an end position sensor which responds after a certain distance traveled during the striking movement.

Advantageously, position measurement can also be employed to measure the length of the entire moving distance of the striking tool, i.e. for measuring the distance to the workpiece. The corresponding measured value can then also be used as a working parameter for defining the current intensities and times or positions, respectively.

For switching off the current exactly after the striking tool has impinged on the workpiece, preferably means for switching off the current when the impinging position is reached can be provided. In a particularly simple manner, the current increase of the supply current for the electromagnet arrangement can be detected with a current sensor, with this current increase taking place when the movement of the magnet keeper, i.e. the striking tool, has been stopped and there is no longer any change in inductivity in the coil of the electromagnet.

After the striking tool has impinged on the workpiece, the current is switched off so that the striking tool is returned to the rest position by the force of the reset device, such as e.g. a spring. Now, for avoiding rebound or need for absorption of the kinetic energy of the striking tool upon return to the rest position by absorption and/or rebounding, advantageously braking means for creating a brake current before the rest position is reached during the return motion of the striking tool can be provided. These means can be controlled in dependence on the time and/or the position, and the current value is selected such that the striking tool is braked, preferably, to a zero speed when the rest position is reached. In this manner, a very fast working cycle can be ensured.

The control equipment advantageously contains a microcomputer with a storage unit in which the working parameters are stored, especially current intensities, times, distance parameters, workpiece properties, temperatures, and the like. The working parameters are suitably contained in the form of tables and can be selected and/or altered in dependence on the respective marking process. Whereas some parameters have to be entered which take into account, e.g., the workpiece properties of the workpiece to be marked, other parameters, such as the temperature, can be detected by sensors, and again others are measured in the manner already indicated, e.g. the position of the striking tool along the entire distance of movement.

Advantageously, the control equipment in the form of a separate module is interposed between a main controller for the marking device and the electromagnet and can be retrofitted.

The various current values can be controlled in open-loop or closed-loop control, dependent on position or time, over the entire moving distance.

BRIEF DESCRIPTION OF THE DRAWINGS

Embodiments of the invention are shown in the figures and explained in detail in the subsequent description.

DESCRIPTION OF THE PREFERRED EMBODIMENTS

Figure 1:
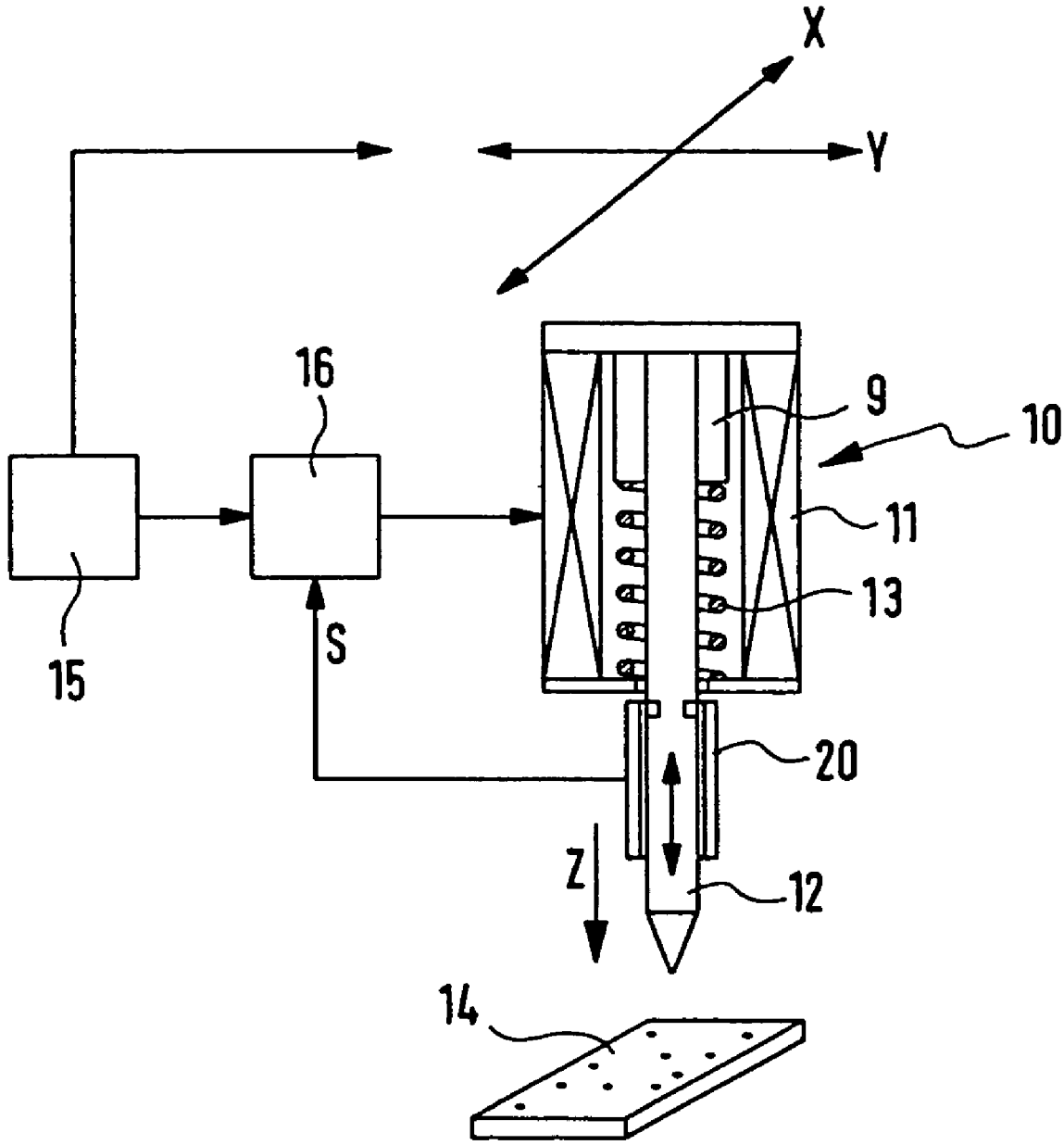
FIG. 1 is a schematic view of the marking device for encoding metallic workpieces with two-dimensional matrix codes.

The marking head 10 which is schematically shown in a pictorial schematic in FIG. 1 is equipped with an electromagnet coil 11 adapted for generating the striking movement of a striking tool 12 which, in this embodiment, is exemplified by a hard metal needle. The striking tool 12 is connected to a magnet keeper 9 which can be moved towards a workpiece 14 against the force of a return spring. Of course, a different well-known return device can also be envisaged, e.g. a return device with pneumatic, hydraulic or electromagnetic action.

The marking head 10 is adjustable, by means of a positioning device (not shown), in the x- and y-directions of a plane arranged in parallel with the plane of the workpiece 14. In this manner, the marking head 10 can reach any position of the workpiece 14. The marking head 10 is used to emboss coding dots in the form of recesses (indentations) in the metallic workpiece 14. These coding dots form a two-dimensional matrix code representing binary encoded information. After the desired grid point has been reached, the striking tool 12 is moved against the workpiece 14 to create the desired code indentation.

Basic control of the marking head 10 is performed by a main controller 15 which controls the position of the marking head 10, by means of the positioning device (not shown), and the triggering of the movement of the striking tool 12.

Figure 2:
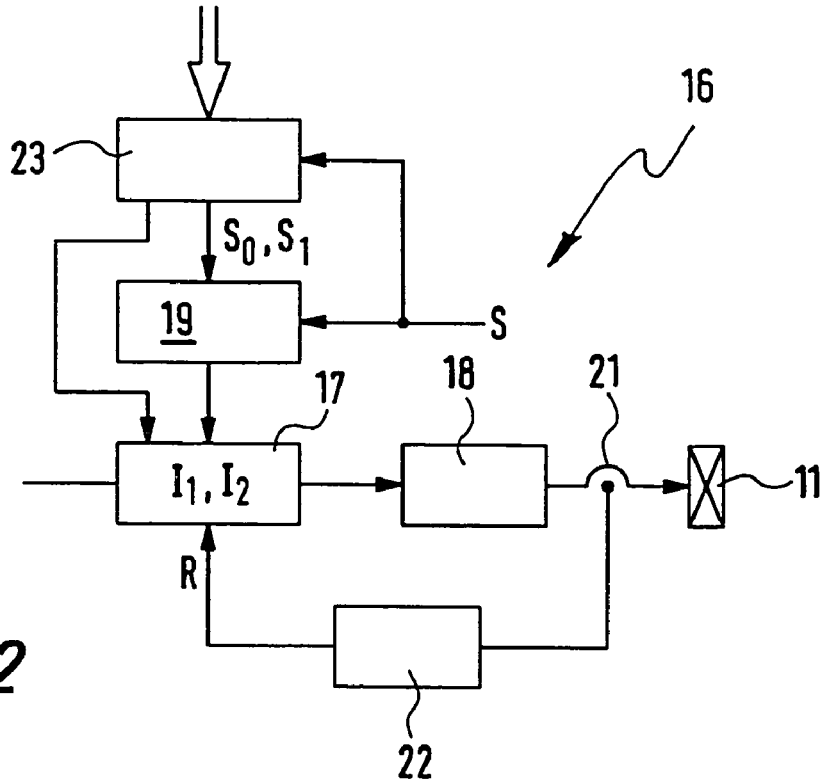
FIG. 2 is a schematic view of a first embodiment with a position-dependent control for the driving movement of the striking tool.

Between the main controller 15 and the electromagnet coil 11, a control unit 16 is interposed by means of which the exact movement of the striking tool 12 is controlled. A first embodiment of this control unit 16 is shown in FIG. 2 and a second embodiment in FIG. 3. In the embodiment shown in FIG. 2, a current control stage 17, which can be triggered from the main controller 15, controls the electromagnet coil 11 of the marking head 10 via an amplifier unit 18. The position signal S of a position detecting device 20 is fed into a position presetting stage 19 for detecting the current position of the striking tool 12. This position detecting device is e.g. an inductive path-measuring system which is arranged outside the electromagnet coil 11 in FIG. 1 but which can also be integral with the magnet drive. In the position presetting stage 19, this position signal S is compared during the striking movement with a stored switchover value $S_0$, and if the same is reached, a switchover is made from an initially high current value $I_1$ to a lower current value $I_2$. The initially high current value $I_1$ is used for fast acceleration of the striking tool 12 during an acceleration phase, wherein the lower current value $I_2$ is selected such that after this acceleration phase, the striking tool can be guided to the workpiece with as uniform a speed as possible. Naturally, the return to the lower current value $I_2$ can also take place in several steps. When the striking tool 12 impinges on the workpiece 14, the supply current for the electromagnet coil 11 rises, since when the movement of the magnet keeper 9 is finished, no change in inductivity in the electromagnet coil 11 any longer takes place. This rise in current is detected by a current sensor 21 and fed into an evaluation stage 22 for the rise in current, which evaluation stage 22 can contain e.g. a differentiation stage. When this rise in current is detected, the current for the electromagnet coil 11 is switched off by means of a reset signal R.

After the current has been switched off, the striking tool 12 and the magnet keeper 9, are moved back into the rest position shown in FIG. 1 by the force of the return spring 13. If during the return motion, a position $S_1$ is detected before the rest position is reached, the current is switched on again by means of the current control stage 17 and then serves as a braking current. During this process, the position $S_1$ and the current intensity are selected such that the striking tool 12 is braked to a speed which is as close to zero as possible when the rest position is reached. For this purpose, either one of the currents $I_1$ or $I_2$ or a different current value can be set.

In a storage unit 23, the working parameters for setting the positions and currents are stored. Such working parameters are e.g. current intensities, times, distance parameters, workpiece properties, temperatures and the like are stored in the form of tables. By means of these tables, the current intensities $I_1$ and $I_2$ as well as the positions $S_0$ and $S_1$ are then preset, e.g. calculated. These are parameters influencing the movement of the striking tool 12. For instance, the temperature of the marking head 10 or the electromagnet coil 11, respectively, can be measured in a manner which is not described in detail. Other working parameters, such as the material properties of the workpiece 14, can be stored by means of an input device which is not shown. Another important parameter is the working stroke, i.e. the distance of the working movement until the tool impinges the workpiece 14. By means of a measuring movement of the striking tool 12, which takes place before the actual marking process, the distance can be measured by the position detecting device 20. The measurement takes place until the tool impinges on the workpiece 14 which is signaled by the evaluation stage 22.

Based on this measured value, the control parameters to be currently used for the respective workpieces 14 are then respectively altered, individually, in such a way that the striking energy effective for marking again corresponds to the desired value.

In another embodiment, this distance measurement can be applied to the position of the workpiece surface to be marked in relation to the assembly height of the marking head 10. To this purpose, the height of the marking head 10 is set adjustably on a third NC axis. Now the striking tool 12 is completely extended with a current set by the current control stage 17, sufficient to overcome the restoring force, and then the marking head 10 is driven against the workpiece surface from a known higher position. As soon as the striking tool 12 strikes the surface, it is retracted until the proximity sensor 20 in the marking head 10 emits a signal. Since the distance from the completely extended striking tool 12 to the switchpoint of the sensor is known, the position of the workpiece surface can be precisely determined from the entire traveling distance and used for precisely setting the desired distance of the striking tool 12 from the workpiece 14. This procedure as well helps to eliminate the negative effects of workpiece tolerances.

After a certain standstill period, the magnet keeper 9 sticks more firmly (adheres) in its rest position than during the stroke movements of the marking process. For this reason, the control unit can increase the acceleration current $I_1$ for the first stroke movement. This increase can be set by reference to stored tables as well.

The current control stage 17 can control the current values $I_1$ and $I_2$ or other current values simply by open-loop control, or it can be adapted as a stage for closed-loop current control.

As a variation of the embodiment explained above, a simple position sensor can also be provided instead of the position measuring device 20; this sensor would only emit a switchover signal in case a fixed predetermined position $S_0$ or $S_1$, respectively, is reached. It can be e.g. an end position sensor which emits a signal when the rest position has been distanced by a certain distance $S_0$ or when the magnet keeper 9 has come closer by a certain distance $S_1$ during the return motion.

The control unit 16 shown in FIG. 2 is, for example, a microcomputer or microcontroller. The storage unit 23 will then be a non-volatile working memory of the microcontroller.

Figure 3:
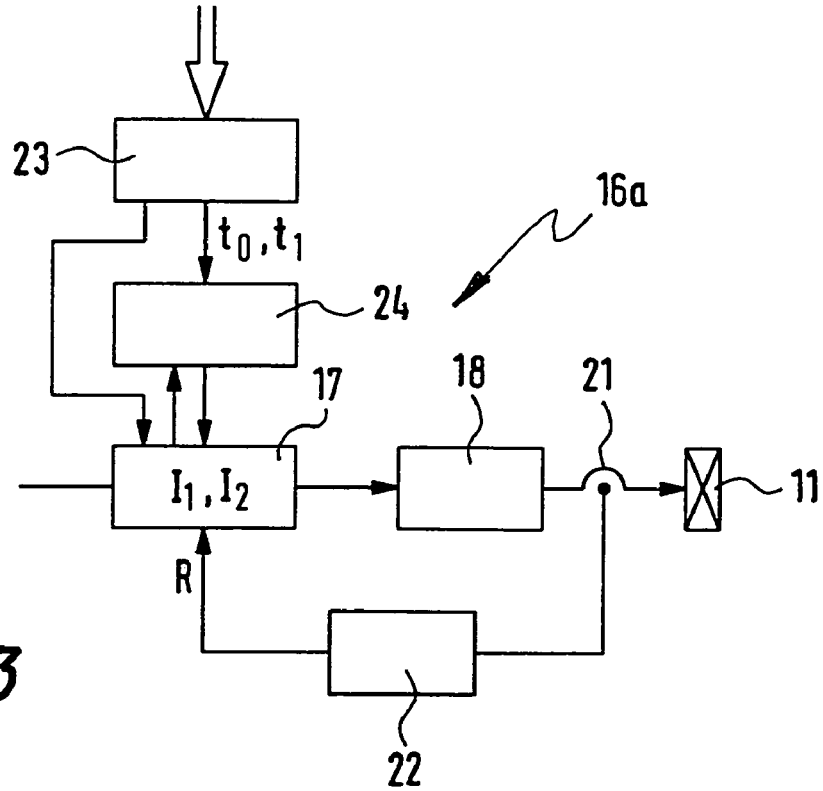
FIG. 3 is a schematic diagram of a second embodiment with time-dependent control for the driving movement of the striking tool.

In FIG. 3, a modified control unit **16*a*** is shown. Same or similarly working modules or elements are labeled with identical reference numbers and not again described in detail.

In the second embodiment, a time presetting stage 24 replaces the position presetting stage 19. The time presetting stage 24 is triggered by a signal of the main controller 15. After a certain time $t_0$, switchover from the higher current value $I_1$ for the acceleration phase to the lower current value $I_2$ for the movement phase takes place. Correspondingly, the braking current is switched on during the return motion of the striking tool 12 after a time $t_1$. The storage unit 23 contains the stored values $t_0$ and $t_1$ which are preset in the working parameter tables according to the first embodiment.

For open-loop and/or closed-loop control of the current, combinations of the two embodiments can also be implemented, i.e. the setting or control of the currents, respectively, take place partly depending on time and partly depending on the position.

The invention claimed is:

1. A marking device for encoding a metallic workpiece with a two-dimensional matrix code, comprising:

a striking tool;

an electromagnetic device for driving the striking tool, with a working movement, to form the two-dimensional matrix code, as plural indentations, in the metallic workpiece;

a return device for generating a force in opposition to the working movement;

a positioning device, displaceable in two dimensions within a plane perpendicular to the direction of the working movement, for positioning the striking tool in a desired encoding position; and an electronic control unit for controlling the working movement of the striking tool, said electronic control unit setting a first current $I_1$ for the electromagnetic device during a first, acceleration phase of the working movement and setting a second current $I_2$, lower than the first current, during a second, moving phase of the working movement, the second, moving phase extending from the first, acceleration phase until impingement of the striking tool on the metallic workpiece.

2. The marking device according to claim 1, further comprising a time control means for presetting the acceleration time.

3. The marking device according to claim 1, further comprising position control means for switchover from the acceleration phase to the subsequent moving phase, responsive to a switchover signal S.

4. The marking device according to claim 3, further comprising a position sensor for controlling switchover in at least one present position ($S_0$) by generation of switchover signal S.

5. The marking device according to claim 4, wherein the position detecting device detects the length of the entire moving distance of the striking tool and/or its distance from the workpiece.

6. The marking device according to claim 5, further comprising, operatively connected to the position measuring device, means for determining the tolerance-affected distance of the marking head from the workpiece surface in a pre-run before marking and for changing the control parameters in accordance with the determined tolerance-affected distance.

7. The marking device according to claim 5 further comprising a height adjusting device, operatively connected to the position detecting device, means for determining the tolerance-affected distance of the marking head from the workpiece surface in a pre-run before marking and for compensating the control parameters, in accordance with the determined tolerance-affected distance, by means of the height adjusting device.

8. The marking device according to claim 1 wherein the electronic control unit provides open-loop control over the entire distance of the working movement in accordance with position or time.

9. The marking device according to claim 1 wherein the electronic control unit provides closed-loop control over the entire distance of the working movement in accordance with position or time.

10. The marking device according to claim 1 further comprising stopping means for switching off the current when the striking tool reaches an impinging position.

11. The marking device according to claim 10 wherein the stopping means recognizes a rise in current which occurs when the impinging position is reached.

12. The marking device according to claim 1 further comprising braking means for creating a braking current before a rest position is reached in movement of the striking tool away from the workpiece.

13. The marking device according to claim 12 wherein the braking means is responsive to detected time and/or position.

14. The marking device according to claim 1 further comprising a main controller for the marking device and wherein the electronic control unit is a separate module interposed between the main controller and the electromagnetic device.

15. The marking device according to claim 1 further comprising means for increasing the higher current ($I_1$) in the acceleration phase during a first working stroke.

* * * * *